US009229395B2

(12) United States Patent
Tamiya

(10) Patent No.: US 9,229,395 B2
(45) Date of Patent: Jan. 5, 2016

(54) METAL SUBSTRATE, FIXING MEMBER, AND HEAT-FIXING DEVICE

(71) Applicant: CANON KABUSHIKI KAISHA, Tokyo (JP)

(72) Inventor: Hirotomo Tamiya, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/693,016

(22) Filed: Apr. 22, 2015

(65) Prior Publication Data

US 2015/0309458 A1 Oct. 29, 2015

(30) Foreign Application Priority Data

Apr. 28, 2014 (JP) ..... 2014-092388

(51) Int. Cl.
*G03G 15/20* (2006.01)

(52) U.S. Cl.
CPC .... *G03G 15/2053* (2013.01); *G03G 2215/2016* (2013.01)

(58) Field of Classification Search
CPC ..... G03G 15/2053; G03G 2215/2016
See application file for complete search history.

(56) References Cited

U.S. PATENT DOCUMENTS

| | | | | |
|---|---|---|---|---|
| 2004/0105708 | A1* | 6/2004 | Imai et al. | 399/330 |
| 2006/0150388 | A1* | 7/2006 | Inada et al. | 29/516 |
| 2012/0012230 | A1 | 1/2012 | Tamiya | |
| 2014/0170440 | A1* | 6/2014 | Kawata et al. | 428/659 |
| 2014/0248174 | A1* | 9/2014 | Fukae et al. | 419/11 |
| 2014/0363693 | A1 | 12/2014 | Tamiya | |

FOREIGN PATENT DOCUMENTS

| | | | |
|---|---|---|---|
| JP | 2005-241891 | A | 9/2005 |
| JP | 2007-070696 | A | 3/2007 |
| JP | 2010-189719 | A | 9/2010 |

OTHER PUBLICATIONS

Extended European Search Report in European Application No. 15165194.0 (dated Aug. 27, 2015).

* cited by examiner

*Primary Examiner* — David Gray
*Assistant Examiner* — Carla Therrien
(74) *Attorney, Agent, or Firm* — Fitzpatrick, Cella, Harper & Scinto

(57) ABSTRACT

Provided is an endless belt-shaped metal substrate, which can be used for a fixing member. The metal substrate includes an austenitic stainless alloy that contains copper and unavoidable impurities, in which the austenitic stainless alloy has a martensite ratio of less than 20%, and includes an austenitic phase as a matrix and a Cu-rich phase dispersed in the matrix, the Cu-rich phase extending in a direction perpendicular to a circumferential direction of the metal substrate.

9 Claims, 4 Drawing Sheets

METAL SUBSTRATE, FIXING MEMBER, AND HEAT-FIXING DEVICE

BACKGROUND OF THE INVENTION

1. Field of the Invention

The present invention relates to an endless belt-shaped metal substrate that can be used as a substrate of a fixing member having an endless belt shape to be used for heat fixing of an electrophotographic image forming apparatus and the like. The present invention also relates to a fixing member and a heat-fixing device, which use the endless belt-shaped metal substrate.

2. Description of the Related Art

Currently, some heat-fixing devices included in electrophotographic image forming apparatus adopt a belt heating system capable of suppressing power consumption.

FIG. 2 is a sectional view illustrating a schematic configuration of a typical belt heating type heat-fixing device. The heat-fixing device includes a fixing belt 11 serving as a fixing member, a pressure roller 20 serving as a pressure member disposed so as to be opposed to the fixing member, and a ceramic heater 12 serving as a heating unit disposed in contact with an inner peripheral surface of the fixing belt 11. The fixing belt 11 and the pressure roller 20 form a fixing nip part N, and a recording material 30 bearing an unfixed toner image T is guided into the fixing nip part N so that toner forming the unfixed toner image T is melted to fix a toner image onto the recording material 30.

FIG. 3 is a sectional view of the fixing member (hereinafter sometimes referred to as "fixing belt") 11 having an endless belt shape. The fixing belt 11 is formed of substantially three layers of a substrate 101, an elastic layer 102, and a surface layer 103 such as a releasing layer in the stated order from the ceramic heater 12 side. As the substrate 101, an endless belt-shaped thin metal substrate (hereinafter sometimes referred to as "metal belt") having high heat conductivity is used.

FIG. 1 is an explanatory view of the fixing belt 11 that is subjected to bending strain in the belt heating type heat-fixing device. In the belt heating system, when the fixing belt 11 passes through the fixing nip part N, the fixing belt 11 is subjected to bending in a circumferential direction on an inlet side and an outlet side. The fixing belt 11 conveyed by a driving roller is repeatedly inserted into the fixing nip part N and thus is repeatedly subjected to the bending.

When the fixing belt 11 is repeatedly subjected to the bending, a fatigue failure may be caused in the metallic substrate of the fixing belt 11. Therefore, in order to enhance the durability of the fixing belt 11, it is necessary to further improve bending resistance also in the metal belt.

In this case, as a material for the metal belt, a relatively inexpensive austenitic stainless-steel sheet having satisfactory processability is used (Japanese Patent Application Laid-Open No. 2005-241891).

A metastable austenitic stainless-steel sheet such as SUS304 can be thinned by plastic forming relatively easily. Further, in such a stainless-steel sheet, at least a part of an austenite phase is transformed into a martensite phase due to plastic forming (hereinafter sometimes referred to as "strain induced transformation"). The martensite phase formed by the strain induced transformation (hereinafter sometimes referred to as "strain induced martensite phase") has a high hardness as compared to the austenite phase, and hence can be formed into a metal substrate having a relatively high surface hardness.

In a metal belt obtained by subjecting a stainless-steel sheet having a high transformation ratio of an austenite phase into a martensite phase after plastic forming (hereinafter referred to as "martensite transformation ratio") to plastic forming, an increase in tensile strength and suppression of a fatigue failure caused by repeated bending are expected due to the formation of the strain induced martensite phase, as described above.

However, according to the investigations conducted by the present inventors, although the metal belt having a martensite ratio increased by strain induced transformation exhibits high tensile strength, there is a high probability that a fatigue failure such as a crack may occur when the metal belt is repeatedly bent. The present inventors have recognized that, in particular, in the case where the stainless-steel sheet is processed into a thin metal belt having a thickness of from 10 to 100 μm, the number of repetitions before the fatigue failure is caused by the repeated bending (product lifetime) varies significantly, resulting in poor reliability.

In view of the foregoing, the present invention is directed to providing a metal substrate for a fixing member in which a fatigue failure is not easily caused by repeated bending.

Further, the present invention is also directed to providing a fixing member and a heat-fixing device, which contribute to the stable formation of a high-quality electrophotographic image.

SUMMARY OF THE INVENTION

According to one aspect of the present invention, there is provided an endless belt-shaped metal substrate, including an austenitic stainless alloy containing copper (Cu) and unavoidable impurities, in which the austenitic stainless alloy has a martensite ratio of less than 20%, and includes an austenitic phase as a matrix and a Cu-rich phase dispersed in the matrix, the copper rich phase extending in a direction perpendicular to a circumferential direction of the endless belt-shaped metal substrate.

According to another aspect of the present invention, there is provided a fixing member, including the above-mentioned endless belt-shaped metal substrate.

According to still another aspect of the present invention, there is provided a heat-fixing device, including: a fixing member; a heating unit configured to heat the fixing member; and a pressure member configured to form a press-contacting nip part together with a side of the fixing member on which at least one of an elastic layer or a releasing layer is formed, the heat-fixing device heating a material to be heated by guiding the material to be heated into the press-contacting nip part between the fixing member and the pressure member and sandwiching/carrying the material to be heated, the fixing member including the fixing member including the above-mentioned endless belt-shaped metal substrate.

Further features of the present invention will become apparent from the following description of exemplary embodiments with reference to the attached drawings.

DESCRIPTION OF THE EMBODIMENTS

Figure 1:
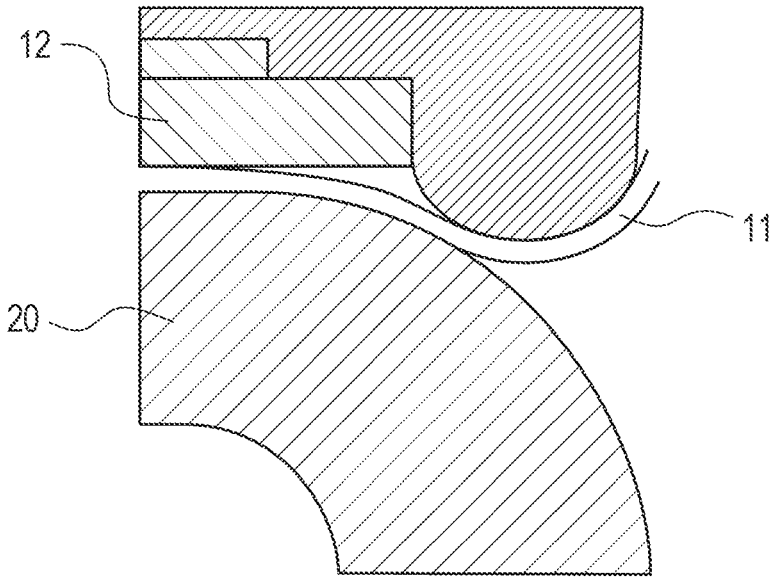
FIG. 1 is an explanatory view of a fixing belt that is subjected to bending strain in a belt heating type heat-fixing device.

Preferred embodiments of the present invention will now be described in detail in accordance with the accompanying drawings.

The present inventors investigated the reason for the following fact: although a metal belt, which is obtained by subjecting a stainless-steel sheet having a high martensite transformation ratio such as SUS304 to plastic forming, exhibits satisfactory tensile strength, a fatigue failure is easily caused in the metal belt by repeated bending. As a result, the present inventors presumed the following. The metal belt having a martensite ratio increased by plastic forming contains a strain induced martensite phase at a relatively high ratio with respect to an austenite phase, and a large number of interfaces between the austenite phase and the martensite phase are formed. Consequently, the bending stress derived from the bending is concentrated on the interfaces, and the interfaces serve as an origin of a failure such as a crack.

Based on the above-mentioned presumption, the present inventors have recognized that it is necessary to suppress a strain induced martensite ratio in order to improve the bending resistance of the metal belt. However, a stainless substrate having a low strain induced martensite ratio does not have tensile strength sufficient for use as a metal substrate for a fixing member.

The present inventors have made an attempt to stabilize and strengthen the austenite phase by precipitating a phase mainly formed of copper (hereinafter sometimes referred to as "Cu-rich phase") in an austenitic stainless steel while suppressing the strain induced martensite ratio. The term "Cu-rich phase" herein employed refers to a domain in which the content ratio of Cu with respect to all the constituent elements except Fe is 60 mass % or more. It is to be noted that the Cu-rich phase may contain Fe and unavoidable impurities in addition to Cu. Incidentally, the reason why Fe is not included into the calculation of the Cu content ratio will be described below. Precipitating the Cu-rich phase so as to increase the strength of the stainless-steel sheet is disclosed in Japanese Patent Application Laid-Open No. 2010-189719 relating to the invention of a stainless-steel sheet for a spring.

As a result of the investigations conducted by the present inventors, the effect of improving the bending resistance was not observed merely by precipitating the Cu-rich phase. Then, the present inventors further conducted investigations and have found that the bending resistance of the metal belt can be improved by forming the Cu-rich phase so that the Cu-rich phase extends in a direction perpendicular to a circumferential direction of the metal belt. In this case, the improvement in bending resistance of the metal belt is presumed as follows. When the Cu-rich phase extends substantially in parallel to a direction in which the austenite phase extends, a stress concentrated on the interface between the austenite phase and the Cu-rich phase is effectively absorbed by the Cu-rich phase.

In the metal belt for a fixing member according to the present invention, the bending fatigue characteristics can be enhanced in spite of the fact that the martensite ratio is suppressed, by causing the above-mentioned thin plate-shaped Cu-rich phase to be formed in the austenite phase. Specifically, when the Cu-rich phase is formed so as to extend in the direction perpendicular to the circumferential direction of the metal belt, the tensile strength is increased by the enhancement of precipitation of the Cu-rich phase, and the bending resistance is improved by the dislocation absorption effect of the Cu-rich phase.

Now, the metal belt is described.

First, the thickness of the metal belt for a fixing member is selected from a range of from 10 to 100 μm. Further, the bending fatigue characteristics can be enhanced mainly when the austenite phase contains the Cu-rich phase extending in the direction perpendicular to the circumferential direction of the metal belt. Therefore, it is preferred that the martensite ratio be low so as to ensure the austenite phase required for strengthening the metal belt and to minimize the martensite phase that forms an interface with the austenite phase, which is to serve as an origin of a failure such as a crack during bending. Specifically, it is preferred that the martensite ratio of the metal belt be suppressed to a state free of the martensite, that is, 0%. Further, even in the case where the martensite phase is inevitably formed due to plastic forming, it is preferred that the martensite ratio in the metal belt be less than 20%, in particular, 10% or less.

The metal belt has a metal structure in which the Cu-rich phase is dispersed in a matrix of the austenite phase, and the metal structure can enhance the bending fatigue characteristics. Although the Cu-rich phase may be formed in the martensite phase, it is preferred that the metal belt have such a metal structure that the Cu-rich phase is dispersed in the matrix of the austenite phase in order to enhance the bending fatigue characteristics significantly.

The content of Cu in an austenitic stainless alloy forming the metal belt is preferably from 1.00 to 8.00 mass %, more preferably from 1.00 to 4.50 mass %. Further, it is preferred that the content of Cu contained in the components excluding Fe in the Cu-rich phase be at least 60 mass %. It is to be noted that the components of the Cu-rich phase, excluding Fe and the unavoidable impurities, may be formed of Cu.

In one embodiment of the present invention, the Cu-rich phase extending in the direction perpendicular to the circumferential direction of the metal belt is defined as a Cu-rich phase in which a line segment forming the largest length of the Cu-rich phase observed from a surface of the metal substrate with a transmission type electron microscope includes a vector component in the direction perpendicular to the circumferential direction of the metal belt.

When the line segment forming the largest length of the Cu-rich phase observed from a surface of the metal substrate with a transmission type electron microscope is defined as a length (L) of the Cu-rich phase, and a line segment perpendicular to the line segment forming the largest length of the Cu-rich phase is defined as a width (W) of the Cu-rich phase, it is preferred that the Cu-rich phase according to one embodiment of the present invention has a shape with a ratio (W:L) between a width (W) and a length (L) of from 1:2 to 1:100.

When the Cu-rich phase having such a shape is existed so as to extend in the direction perpendicular to the circumferential direction of a stainless endless belt having a martensite ratio of less than 20%, the bending resistance of the endless belt can be improved significantly. The reason for this is considered as follows. When the existence ratio of the brittle martensite phase is suppressed to less than 20%, in particular, less than 10%, and the flexible Cu-rich phase is formed so as to extend in the direction perpendicular to the circumferential direction of the endless belt, a stress applied to the endless belt when the endless belt is bent is alleviated.

<Fixing Member>

The fixing member can have various forms depending on structures of fixing devices to which the fixing member is to be mounted. However, for the reasons of making the setting position of the fixing member within the fixing device compact, making fixing treatment efficient, and the like, the fixing member has the form of a fixing belt in most cases. Therefore, in the description below, a fixing belt is described as an example of the fixing member according to the present invention. It is to be noted that a fixing member for heating and fixing an unfixed toner image, serving as the fixing member according to the present invention, includes a surface that is brought into contact with the unfixed toner image and a surface that slides on a heating surface of a heating unit.

It is to be noted that as a substrate of the fixing member, the above-mentioned metal belt according to the present invention is used. In addition, there may be adopted such a configuration that at least one of an elastic layer or a releasing layer is formed on at least one surface of the metal belt. As a more specific configuration, there is given such a configuration that the elastic layer and the releasing layer are laminated in the stated order on at least one surface of the metal belt.

The elastic layer can be formed so as to form a press-contacting nip part, which enables uniform pressurization, more effectively, and can be formed of a material having elasticity such as a silicone rubber. Specifically, an elastic layer containing a cured material of an addition-curable silicone rubber composition or the like is preferably used.

Further, the releasing layer can be formed in the case where it is necessary to prevent the occurrence of an offset by ensuring a release property with respect to a toner image surface. Specifically, there are given layers containing a fluorine resin and a fluorine rubber.

Figure 2:
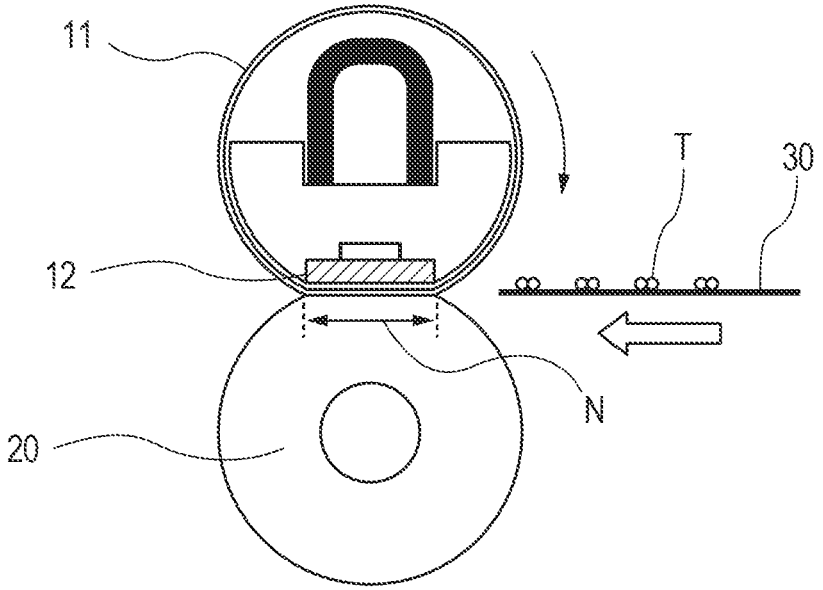
FIG. 2 is a sectional view illustrating a schematic configuration of the belt heating type heat-fixing device.
Figure 3:
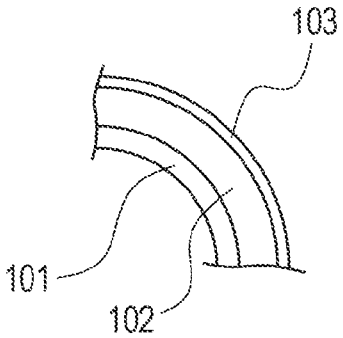
FIG. 3 is a sectional view of a typical fixing belt.

The above-mentioned fixing member according to the present invention can be used as a fixing member of a heat-fixing device illustrated in FIG. 2. The heat-fixing device can be preferably used for fixing an unfixed toner image in an electrophotographic image forming apparatus. Thus, a heat-fixing device that contributes to the long-term and stable formation of an electrophotographic image can be obtained. That is, the fixing device according to the present invention includes a fixing member, a pressure member arranged so as to be opposed to the fixing member, and a heating unit of the fixing member, and as the fixing member, the above-mentioned fixing member according to the present invention is used. As an example of the heating unit, for example, there is given a heater such as a ceramic heater. A recording material serving as a material to be heated can be heated by being guided into the press-contacting nip part between the fixing member and the pressure member and sandwiched/carried therebetween.

Herein, in the case where, as the fixing member, an endless fixing member having such a configuration that at least one of the elastic layer or the releasing layer is laminated on the metal substrate is used, the heater can be arranged so as to be brought into direct or indirect contact with the metal substrate of the fixing member. In this case, a sliding layer (not shown) containing polyimide and the like may be formed on a surface of the metal substrate on a side opposed to the heater.

Further, the image forming apparatus according to the present invention including the above-mentioned fixing device can form a high-quality electrophotographic image stably for a long period of time.

Now, a manufacturing method for an endless fixing belt serving as the fixing member and a steel material to be used therefor are described.

—Manufacturing Method for Fixing Belt Base Layer—

An endless belt-shaped metal substrate, that is, a metallic endless belt to be used for a substrate (base layer) of the fixing belt can be manufactured by a method including the following steps.

(1) A cup-shaped member is obtained from a stainless-steel sheet by drawing. The thickness of the stainless-steel sheet is preferably 1.0 mm or less, more preferably 0.2 mm or more and 0.5 mm or less.

(2) The cup-shaped member obtained in the step (1) is subjected to heat treatment at a temperature of 900° C. or less to obtain a cup-shaped member containing a spherical or bar-shaped precipitated Cu-rich phase. Further, it is preferred that the lower limit of the heating temperature in the heat treatment be set to a recrystallization start temperature of a stainless-steel sheet forming the cut-shaped member. The Cu-rich phase can be precipitated in a metal structure more efficiently by setting the temperature of the heat treatment to the recrystallization start temperature or more and 900° C. or less. In this case, the recrystallization start temperature varies also depending on the kind of the stainless-steel sheet and the degree of plastic forming to which the stainless-steel sheet is subjected due to drawing conducted for obtaining the cup-shaped member. As an example, the recrystallization start temperature of an austenitic stainless-steel sheet used in Example described later is 750° C.

(3) The cup-shaped member obtained in the step (2) is subjected to plastic forming at a processing rate of 75% or more so that the thickness is thinned to from 0.01 to 0.1 mm. During the step of thinning, the copper rich phase formed in the step (2) is drawn and formed so as to extend in the direction perpendicular to the circumferential direction of the thinned cup-shaped member. After that, a bottom portion of the thinned cup-shaped member is cut to obtain a metallic seamless belt having a thickness of from 0.01 to 0.1 mm. A method for plastic forming in the step (3) can be appropriately selected from processing methods such as drawing, rolling, a drawing process, press working, ironing, and spinning.

The thickness of the stainless-steel sheet before plastic forming for subjecting the austenite phase to work hardening is preferably 1.0 mm or less, more preferably 0.5 mm or less from the viewpoint of preferably performing hardness adjustment at the processing rate regarding the thickness in plastic forming. Further, from the same viewpoint, it is preferred that the thickness of the stainless-steel sheet before plastic forming be set to 0.2 mm or more.

—Stainless-Steel Sheet for Fixing Belt Base Layer—

In general, an austenitic stainless-steel sheet has the following composition.

C: 0.01 to 0.15 mass %;
Si: 0.01 to 1.00 mass %;
Mn: 0.01 to 2.00 mass %;
Ni: 6.00 to 15.00 mass %;
Cr: 15.00 to 20.00 mass %;
Balance: Fe and unavoidable impurities.

As the unavoidable impurities, there are given P that is contained at a ratio of 0.045 mass % or less in some cases, S that is contained at a mass ratio of 0.030 mass % or less, and the like.

As a specific example of the austenitic stainless-steel sheet having a nickel content of 8 mass % or more, for example, there is given SUS304.

In this case, SUS304 generally has the following composition as described in the Japanese Industrial Standards (JIS) G 4305 (2010).

C: 0.01 to 0.08 mass %;

Si: 0.01 to 1.00 mass %;

Mn: 0.01 to 2.00 mass %;

Ni: 8.00 to 10.50 mass %;

Cr: 18.00 to 20.00 mass %;

Balance: Fe and unavoidable impurities.

Further, as the unavoidable impurities, there are given P that is contained at a ratio of 0.045 mass % or less in some cases, S that is contained at a mass ratio of 0.030 mass % or less, and the like, as described above.

The austenitic stainless-steel sheet typified by SUS304 has satisfactory processability and hence can be thinned easily by plastic forming. Further, the austenitic stainless-steel sheet has a high work-hardening ratio with respect to plastic forming and has relatively satisfactory durability as the fixing belt. Further, for the reason that the austenitic stainless-steel sheet is less liable to be oxidized and is degraded less with the passage of time, and the like in an environment within the heat-fixing device, the austenitic stainless-steel sheet is often used as a material for a metallic seamless belt for the fixing belt. It is known that the austenitic stainless-steel sheet is subjected to strain induced martensite transformation due to plastic forming at room temperature, and an austenite structure before plastic forming is transformed into a martensite structure having a high hardness.

As the austenitic stainless-steel sheet serving as a material for obtaining the metal substrate in which the Cu-rich phase is formed in the austenite phase according to the present invention, those containing Cu at from 1.00 to 8.00 mass % in addition to the above-mentioned components can be preferably used.

Austenitic stainless-steel sheets containing Cu at 1.00 mass % or more and 8.00 mass % or less are exemplified below.

SUSXM7, SUS303Cu, SUS304Cu, SUS304J1, SUS304J2, SUS304J3, SUS315J1, SUS315J2, SUS316J1, SUS316J1L, SUS317J5L, and SUS890L.

Of those, SUSXM7, SUS303Cu, SUS316J1, and SUS316J1L are particularly preferred because martensite transformation is much less liable to occur even due to plastic forming.

As an indicator of the stability of the austenite phase with respect to plastic forming, there is given an $Md_{30}$ determined by Equation 1 from the chemical component content of a material. The $Md_{30}$ is expressed in a unit of (° C.) and called an austenite stabilization index. As the numerical value of the $Md_{30}$ becomes larger on a plus side, the stability of the austenite phase becomes lower, and a martensite transformation amount after plastic forming increases.

$$Md_{30}=551-462(C+N)-9.2Si-8.1Mn-13.7Cr-29(Ni+Cu)-18.5Mo \quad \text{Equation (1))}$$

The hardness of the austenitic stainless-steel sheet subjected to plastic forming increases in proportion to the transformation amount of the martensite phase. Therefore, by selecting a steel sheet of the kind having a large $Md_{30}$ and subjecting the steel sheet to the steps (1) to (3) of the manufacturing method for a fixing belt substrate, a thin metallic seamless belt having high strength can be obtained, in which the Cu-rich phase is precipitated in a dispersed state in the matrix of the autstenite phase, and the Cu-rich phase is formed so as to extend in the direction perpendicular to the circumferential direction of the endless belt-shaped metal substrate.

It is to be noted that in order to increase the strength of the thin metal belt, it is also necessary to increase the tensile strength. However, as described above, increasing the tensile strength of the thin metal belt through strain induced martensite may serve as a factor for the fatigue failure during bending caused by a stress concentrated on the interface between the austenite phase and the strain induced martensite phase. In particular, in the metal belt having a thickness of 100 μm or less, an increase in occurrence probability of the fatigue failure during bending caused by the formation of the strain induced martensite tends to become more conspicuous. That is, in the thin metal belt having a thickness of 100 μm or less, when the strain induced martensite is formed in a large amount, the number of repetitions before the fatigue failure is caused varies significantly, with the result that a failure probability with a standard deviation of −3σ described later becomes low.

Figure 6:
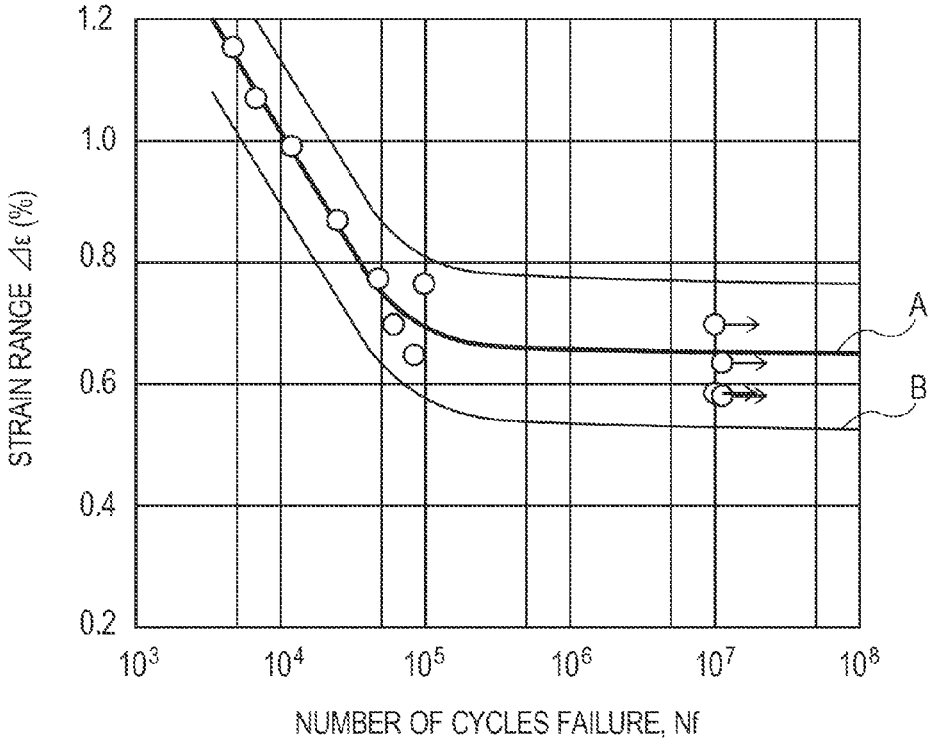
FIG. 6 is a graph showing a failure probability with a standard deviation of $-3\sigma$ determined from the results of a bending fatigue test of the metallic seamless belt.

FIG. 6 is a graph showing how to determine a failure probability with a standard deviation of −3σ. The vertical axis of FIG. 6 represents a loaded strain range, and the horizontal axis thereof represents the number of cycles of a failure. Data with the arrows shows that a failure did not occur and hence evaluation was stopped. The solid line denoted by "A" in FIG. 6 represents a failure probability of 50%, and the solid line denoted by "B" shows a failure probability with a standard deviation of −3σ. In this manner, the results of fatigue strength measurement can be represented by a failure probability that is regressed statistically, and a product having high reliability with respect to the fatigue failure can be obtained by designing a product so as to achieve the failure probability with a standard deviation of −3σ or less. Therefore, a thin metallic seamless belt, which has a high failure probability of 50% and a small variation in number of repetitions before a failure is caused under the condition that the same strain range is loaded, can be considered as a member that has a high failure probability with a standard deviation of −3σ and is effective for preventing the fatigue failure.

Austenitic stainless steel is an alloy containing chromium and nickel in largest amounts. Chromium is a component effective for enhancing corrosion resistance of stainless steel, and nickel is a component effective for stabilizing the autstenite phase. Further, as is understood from the expression of the $Md_{30}$, the content of copper influences the martensite transformation ratio in the same way as in nickel.

In particular, in the case where the contents of nickel and copper are 10.00% or more in an austenitic stainless-steel sheet based on the Japanese Industrial Standards (JIS) G 4305 (2010), the formation of the strain induced martensite phase is suppressed in the austenitic stainless-steel sheet, and the austenite phase can be present extremely stably even after plastic forming. As a result, the metal belt manufactured by the steps (1) to (3) of the manufacturing method for a fixing belt substrate cannot be expected to have strength increased by the strain induced martensite phase.

However, the metal belt according to the present invention has such a metal structure that the thin plate-shaped Cu-rich phase is dispersed and precipitated in the matrix of the austenite phase, and the precipitated Cu-rich phase increases the strength of the metal belt. That is, the metal belt according to the present invention is not increased in strength by the strain induced martensite but is increased in strength by the precipitation of the Cu-rich phase.

Further, in the metal belt, the Cu-rich phase softer than the austenite phase is present extending in the direction perpendicular to the circumferential direction of the metal belt, and it has been confirmed from an electron beam diffraction pattern that the Cu-rich phase is present in a perfect parallel orientation relationship with respect to the austenite phase as the matrix. This means that a boundary between a lath-shaped austenite phase (F.C.C structure a=b=c=3.600 Å) and a thin plate-shaped Cu-rich phase (F.C.C structure a=b=c=3.165) is a phase in which the two layers are matched in lattice crystal-structurally and stresses are difficult to be concentrated. It is presumed that, due to the presence of the Cu-rich phase, even when the metal belt is subjected to repeated strain, the thin plate-shaped Cu-rich phase softer than the austenite phase exhibits a damper effect (dislocation absorption effect) of absorbing load strain, and thus the failure probability with a standard deviation of −3σ, which is regressed statistically, is enhanced significantly.

According to one aspect of the present invention, a substrate excellent in bending resistance can be obtained. Further, according to another aspect of the present invention, a fixing member and a heat-fixing device that contribute to the stable formation of a high-quality electrophotographic image can be obtained.

—Evaluation Method—

(Confirmation of Cu-Rich Phase)

A sample (depth: 10 μm, width: 10 μm, thickness: 0.1 μm) on which a cross section parallel to the circumferential direction of a metal belt appeared is cut out from a metal belt by an FIB-μ sampling method. The cross section parallel to the circumferential direction of the metal belt in the obtained sample is observed at an accelerating voltage of 200 kV and a magnification of 200,000 times with an field-emission electron microscope (trade name: HF-2000; manufactured by Hitachi, Ltd.) and a domain which is presumed to be a Cu-rich phase located in a field of view of 450 nm×350 nm is specified. The thus specified domain is analyzed with an energy dispersive X-ray spectrometer (trade name: EDS2008 ver1.1 RevC; manufactured by IXRF SYSTEMS INC.; incident probe diameter: 2 nm) at an accelerating voltage of 200 kV.

From the results of the elemental analysis of the domain obtained from the above-mentioned analysis, the content ratio of Cu with respect to all the constituent elements except Fe is calculated. When the thus obtained content ratio of Cu is 60 mass % or more, the analyzed domain is deemed to be a Cu-rich phase.

Incidentally, the reason why Fe is not included into the calculation of the Cu content ratio is as follows. That is, as the content ratio of Cu in a domain of a metal belt, the content ratio of Cu with respect to all the elements constituting the domain should normally be calculated. However, the size of the domain is small as compared with an area that can be analyzed by an energy dispersive X-ray spectrometer with an incident probe diameter of 2 nm. Therefore, even when elemental analysis of such a domain is performed, the obtained elemental analysis results will inevitably contain information on the elements constituting the matrix. Accordingly, in the present invention, the content ratio of Cu in a domain will be calculated while precluding information on Fe having the highest content ratio among the constituent elements of the matrix.

(Fatigue Strength Measurement)

Figure 5A:
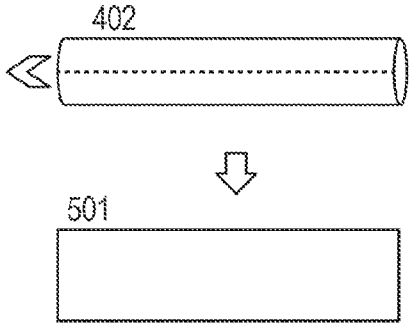
FIG. 5A is a view illustrating a direction in which the metallic seamless belt is cut into a sheet-shaped member.
Figure 5B:
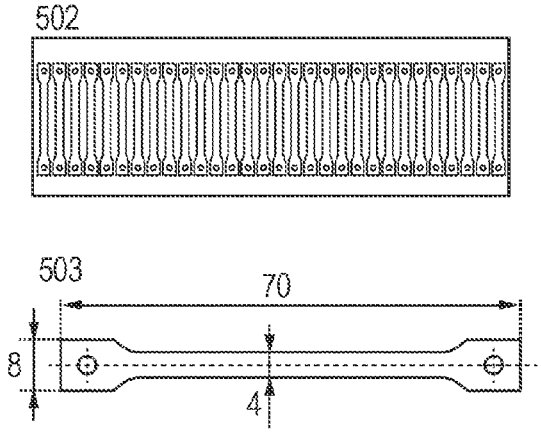
FIG. 5B is a view illustrating a direction in which a dumbbell-shaped test piece is manufactured from the sheet-shaped member.

FIGS. 5A and 5B are explanatory views illustrating a method of obtaining a test piece for fatigue strength measurement from a metal belt.

First, a metal belt 402 was cut to be opened in an axis direction of the metal belt 402 as illustrated in FIG. 5A to obtain a sheet-shaped member 501. Next, as illustrated in FIG. 5B, a dumbbell-shaped test piece 503 (unit of each dimension: mm) was obtained from the sheet-shaped member 501 in a direction perpendicular to the axis direction of the metal belt 402 as denoted by reference numeral 502 to be used as a test piece for fatigue strength measurement.

The fatigue strength measurement was conducted through use of the above-mentioned test piece in accordance with the Japan Spring Manufacturers Association Standards (JSMA Standards) SD007:1996 "Fatigue Test Method for Spring Thin Plate). As a measurement device, a metal foil fatigue test machine (manufactured by Nippon Bellparts Co., Ltd.) was used.

The strain to be loaded repeatedly on the test piece was changed depending on a test pulley diameter. In the case where no failure occurred even when the strain was loaded on the test piece up to the maximum number of repetitions of $10^7$, the fatigue strength measurement was stopped. The tensile loading for bringing the test piece into close contact with the test pulley was set to 10 N. Ten or more test pieces were evaluated, and the strain was adjusted so that no failure occurred in four or more test pieces at the number of repetitions of $10^7$ or more and a failure occurred in six or more test pieces at the number of repetitions of less than $10^7$. Based on the data obtained from the fatigue strength measurement, the failure probability with a standard deviation of −3σ was determined in accordance with JSMS-SD-6-08 Standard Evaluation Method of Fatigue Reliability for Metallic Materials (Standard Regression Method of S-N Curves), The Society of Materials Science, Japan.

(Measurement of Martensite Ratio)

Next, a measurement method for a martensite ratio is described. The martensite ratio was calculated from a ferrite value. The ferrite value is an indicator capable of evaluating a ratio at which the austenite phase is transformed into the martensite phase due to plastic forming. It is to be noted that when the thickness of a measurement sample is 2 mm or less, the ferrite value becomes small depending on the thickness. Therefore, the martensite ratio of the metal belt according to the present invention was measured as follows. A plurality of test pieces are cut out from the metal belt to be measured. First, one test piece is measured for a ferrite value. Then, two test pieces are superimposed on top of the other and measured for a ferrite value. Then, three test pieces are superimposed on top of the other and measured for a ferrite value. The ferrite value is measured every time the number of the test pieces to be superimposed is increased by one. The saturated ferrite value is considered as the ferrite value of the metal belt to be measured. It is to be noted that for measuring the ferrite value, a multi-system thickness meter (trade name: "Fischer Scope MMS"; manufactured by Fischer Scope, K.K. Japan) was used.

(Tensile Strength)

A test piece for tensile strength measurement was manufactured by the same method as that of the test piece for fatigue strength measurement. That is, a metal belt 402 was cut to be opened in an axis direction of the metal belt 402 to obtain a sheet-shaped member. Next, a dumbbell-shaped test piece 503 was obtained from the sheet-shaped member in a direction perpendicular to the axis direction of the metal belt 402. It is to be noted that the length of the test piece for fatigue strength measurement illustrated in FIG. 5B was 70 mm, whereas the length of the test piece for tensile strength measurement was set to 50 mm, and holes were formed on both sides of the test piece for fatigue strength measurement, whereas such holes were not formed in the test piece for tensile strength measurement.

Further, for measuring the tensile strength, a precision universal test machine (trade name: "Shimadzu Autograph AG-50kNX; manufactured by Shimadzu Corporation) was used. The measurement environment was a room temperature of 27° C. and a relative humidity of 70%. Further, elongation was detected at a test speed of 5 mm/min and a sample inter-marked line distance of 15 mm.

EXAMPLES

Now, the metallic seamless belt for a fixing belt base layer according to the present invention is specifically described by way of Example.

Example 1

SUSXM7 was prepared as a stainless-steel sheet for forming a metal belt according to this example. The stainless-steel sheet was an austenitic stainless-steel sheet containing Cu at from 1 to 4.5 mass %. The $Md_{30}$ of the stainless-steel sheet was −108.

The stainless-steel sheet was subjected to cold rolling to a thickness of 0.22 mm. Then, the resultant steel sheet was subjected to vacuum heat treatment at 850° C. for 40 minutes and slow cooling. The cooling speed was set to 200° C./hour. It is to be noted that a metal belt was obtained through use of the stainless-steel sheet. The method of obtaining the metal belt is described below.

Figure 4A:
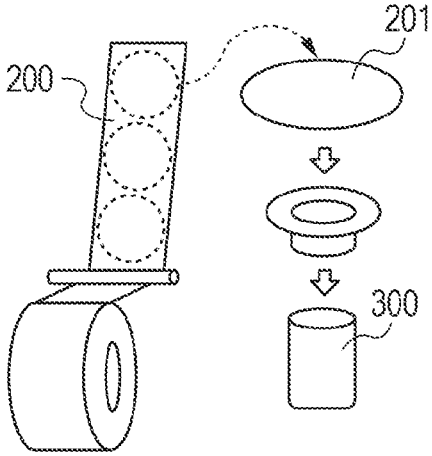
FIG. 4A is a view illustrating a drawing step of obtaining a cup-shaped member from a stainless-steel sheet.
Figure 4B:
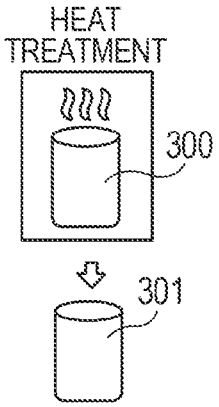
FIG. 4B is a view illustrating a step of subjecting the cup-shaped member to heat treatment.
Figure 4C:
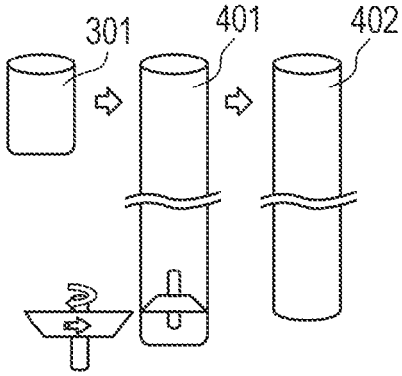
FIG. 4C is a view illustrating a thinning step of obtaining a metallic seamless belt from the cup-shaped member.

FIGS. 4A, 4B, and 4C are views illustrating a method of obtaining a metal belt 402 from the above-mentioned stainless-steel sheet obtained by vacuum heat treatment and slow cooling.

First, a disc-shaped member 201 was punched out from a stainless-steel sheet having a thickness of 0.22 mm obtained by vacuum heat treatment and slow cooling. The disc-shaped member 201 was subjected to drawing 4 times to obtain a cup-shaped member 300 having a side wall thickness of 0.20 mm (FIG. 4A).

Next, as illustrated in FIG. 4B, the cup-shaped member 300 was heated to a temperature of 850° C. and held for 40 minutes, and thereafter cooled slowly to room temperature (25° C.). The cooling speed was set to 200° C./hour. Due to the heat treatment, the strain applied to the cup-shaped member 300 by drawing was removed to obtain a cup-shaped member 301.

Finally, as illustrated in FIG. 4C, the cup-shaped member 301 obtained in the previous step was subjected to ironing 9 times to be thinned, and thus a cup-shaped member 401 thinned at a processing rate of a total ironing ratio of 80% was obtained. A bottom portion of the obtained thinned cup-shaped member 401 was cut to obtain a metal belt 402 having a thickness of 0.035 mm.

In order to observe the presence and form of a Cu-rich phase from the metallic endless belt, the following analysis was performed.

First, a first observation sample (depth: 10 μm, width: 10 μm, thickness: 0.1 μm) on which a cross section parallel to the circumferential direction of the metal belt 402 appeared was cut out from the obtained metal belt 402 by an FIB-μ sampling method. The cross section parallel to the circumferential direction of the metal belt 402 in the obtained first observation sample was observed at an accelerating voltage of 200 kV and a magnification of 200,000 times with an field-emission electron microscope (trade name: "HF-2000"; manufactured by Hitachi, Ltd.) and analyzed for a plurality of domains located in a field of view of 450 nm×350 nm with an energy dispersive X-ray spectrometer (trade name: EDS2008 Ver. 11 RevC; manufactured by IXRF SYSTEMS INC.) at an accelerating voltage of 200 kV. As a result, all the domains showed Cu content ratios of 60 mass % or more with respect to all the constituent elements except Fe.

Next, the metal belt 402 according to this example was polished from a front surface and a back surface by electropolishing (twin jet) and ion milling to obtain a second observation sample having a thickness capable of transmitting an electron beam. A surface of the obtained second observation sample was observed at a magnification of 200,000 times with a field-emission electron microscope (trade name: "HF-2000"; manufactured by Hitachi, Ltd.) to measure a width and a length of all the Cu-rich phases located in the field of view of 450 nm×350 nm and also observed for a direction in which a segment forming the largest length of each Cu-rich phase extended. As a result, all the Cu-rich phases had a ratio (W:L) of a width (W) and a length (L) within a range of from 1:2 to 1:100. Further, the segment forming the maximum length had a vector component in the direction perpendicular to the circumferential direction of the endless belt.

Figure 7:
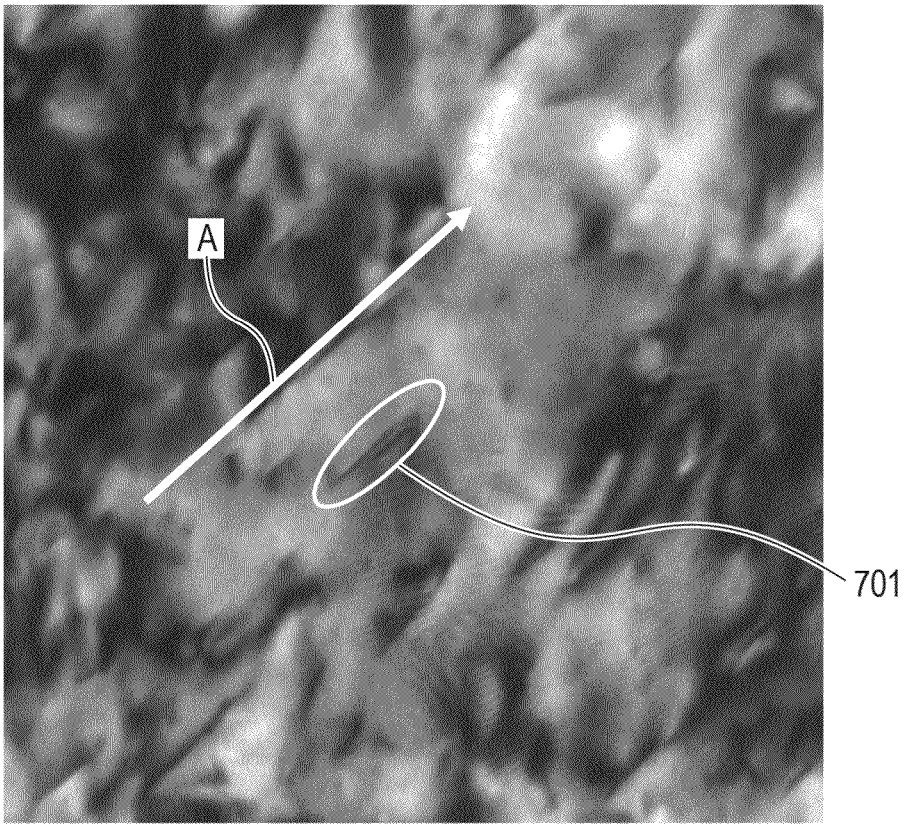
FIG. 7 is a transmission type electron microscopic image of a sample manufactured from a metal belt according to Example 1.

More specifically, in the endless belt according to this example, a lath-shaped austenite phase of about from 10 to 100 nm was formed so as to extend in the direction perpendicular to the circumferential direction of the endless belt. Further, the Cu-rich phase was precipitated inside the austenite phase and at a lath interface in a perfect parallel orientation with respect to the austenite phase. It is to be noted that FIG. 7 shows an electron microscopic image of the second observation sample. As shown in FIG. 7, a needle-shaped Cu-rich phase 701 extended in the direction perpendicular to the circumferential direction of the metal belt 402, denoted by the arrow A.

Table 1 shows a failure probability with a standard deviation of −3σ obtained by fatigue strength measurement, a martensite ratio, and tensile strength of the metal belt 402 obtained in this example.

Comparative Example 1

First, a stainless-steel sheet SUS304L based on the Japanese Industrial Standards (JIS) G 4305 (2010) was prepared. The stainless-steel sheet was rolled to a thickness of 0.22 mm by cold rolling and annealing. The $Md_{30}$ of the stainless-steel sheet was −26. It is to be noted that the stainless-steel sheet was free of Cu for forming a Cu-rich phase. A metal belt according this comparative example was manufactured in the same way as in the metal belt according to Example 1 except for using the above-mentioned stainless-steel sheet.

It is to be noted that the metal belt according to this comparative example was manufactured from the stainless-steel sheet free of Cu, and hence the production and evaluation of the first and second observation samples for analyzing the Cu-rich phase performed in Example 1 were not performed.

The obtained metal belt according to this comparative example was measured for fatigue strength, a martensite ratio, and tensile strength. Table 1 shows the results.

Comparative Example 2

First, a stainless-steel sheet SUS304 based on the Japanese Industrial Standards (JIS) G 4305 (2010) was prepared. The stainless-steel sheet was rolled to a thickness of 0.22 mm by cold rolling and annealing. The $Md_{30}$ of the stainless-steel sheet was 12. The stainless-steel sheet was free of Cu for forming a Cu-rich phase. A metal belt according this comparative example was manufactured in the same way as in Example 1 except for using the above-mentioned stainless-steel sheet.

It is to be noted that the metal belt according to this comparative example was also manufactured from the stainless-steel sheet free of Cu, and hence the production and evaluation of the first and second observation samples for analyzing the Cu-rich phase in Example 1 were not performed.

The obtained metal belt according to this comparative example was measured for fatigue strength, a martensite ratio, and tensile strength. Table 1 shows the results.

Comparative Example 3

First, the same stainless-steel sheet as the stainless-steel sheet used in Example 1 was prepared. A cup-shaped member was obtained through use of the stainless-steel sheet by the same method as that of Example 1. The obtained cup-shaped member was heated to a temperature of 1,050° C. and held for 5 minutes. Then, the cup-shaped member was cooled rapidly to room temperature (27° C.) through use of nitrogen gas. The cooling speed was set to 5° C./sec.

The cup-shaped member was subjected to ironing 9 times to be thinned, and thus a cup-shaped member 401 thinned at a processing rate of a total ironing ratio of 80% was obtained. A bottom portion of the obtained thinned cup-shaped member 401 was cut to obtain a metal belt 402 having a thickness of 0.035 mm.

First and second observation samples were produced from the obtained metal belt 402 and evaluated in the same way as in Example 1. As a result, the presence of a Cu-rich phase was not confirmed from the first and second observation samples. The reason for this is considered as follows. When the cup-shaped member 401 was subjected to heat treatment involving heating the cup-shaped member 401 to 1,050° C., holding the cup-shaped member 401 for 5 minutes, and thereafter rapidly cooling the cup-shaped member 401 to room temperature, a Cu-rich phase that had been present before the heat treatment was dissolved in a solid state in the austenite phase and disappeared.

Further, the metal belt 402 was measured for fatigue strength, a martensite ratio, and tensile strength. Table 1 shows the results.

Comparative Example 4

A metal belt was manufactured in the same way as in Example 1. The obtained metal belt was held at a temperature of 850° C. for 40 minutes and cooled slowly to room temperature. The cooling speed was set to 200° C./hour.

First and second observation samples were produced from the metal belt thus obtained and evaluated in the same way as in Example 1.

As a result, it was confirmed from the first and second observation samples that a spherical Cu-rich phase was present. That is, the Cu-rich phase was not formed so as to extend in the direction perpendicular to the circumferential direction of the metal belt.

The reason for the formation of the spherical Cu-rich phase is considered as follows. When the metal belt manufactured in the same way as in Example 1 was held at a temperature of 850° C. for 40 minutes and cooled slowly, the Cu-rich phase that had extended in the direction perpendicular to the circumferential direction of the metal belt was melted and reprecipitated. The metal belt according to this comparative example was measured for fatigue strength, a martensite ratio, and tensile strength. Table 1 shows the results. It is to be noted that the reason for the martensite ratio of 0% is considered as follows: when the metal belt was held at a temperature of 850° C. for 40 minutes and cooled slowly, the strain induced martensite phase was returned to the austenite phase.

TABLE 1

| | Martensite ratio | Cu-rich phase | | −3σ | Tensile strength |
|---|---|---|---|---|---|
| | (%) | Presence/absence | State | (%) | (MPa) |
| Example 1 | 7 | Present | Needle shape Oriented in direction perpendicular to circumferential direction of metal belt | 0.53 | 1627 |
| Comparative Example 1 | 61 | Absent | — | 0.36 | 1651 |
| Comparative Example 2 | 81 | Absent | — | 0.43 | 2078 |
| Comparative Example 3 | 6 | Absent | — | 0.28 | 1454 |
| Comparative Example 4 | 0 | Present | Spherical shape | 0.41 | 728 |

As shown in Table 1, it is understood that the metal belt according to the present invention has high tensile strength. Further, it is understood that the metal belt according to the present invention has a high failure probability with a standard deviation of −3σ and has a low probability of a fatigue failure such as a crack even when the metal belt is repeatedly bent, that is, the metal belt has high reliability.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-092388, filed Apr. 28, 2014 which is hereby incorporated by reference herein in its entirety.

What is claimed is:

1. An endless belt-shaped metal substrate, comprising
an austenitic stainless alloy containing copper and unavoidable impurities, wherein
the austenitic stainless alloy
has a martensite ratio of less than 20%, and includes
an austenitic phase as a matrix, and
a Cu-rich phase dispersed in the matrix,
the Cu-rich phase extending in a direction perpendicular to a circumferential direction of the endless belt-shaped metal substrate.

2. The endless belt-shaped metal substrate according to claim 1, having a thickness of 10 to 100 μm.

3. The endless belt-shaped metal substrate according to claim 1, wherein the martensite ratio is 10% or less.

4. The endless belt-shaped metal substrate according to claim 1, wherein a content of Cu in the austenitic stainless alloy is 1 to 4.5 mass %.

5. The endless belt-shaped metal substrate according to claim 1, wherein a content of Cu in the Cu-rich phase is 60 mass % or more.

6. An endless belt-shaped fixing member, comprising the endless belt-shaped metal substrate according to claim 1.

7. The endless belt-shaped fixing member according to claim 6, wherein the endless belt-shaped metal substrate has at least one of an elastic layer and a releasing layer provided on a circumferential surface of the endless belt-shaped metal substrate.

8. A heat-fixing device, comprising:

a fixing member;

a heating unit configured to heat the fixing member; and a pressure member configured to form a press-contacting nip part together with the fixing member, the heat-fixing device heating a material to be heated by guiding the material to be heated into the press-contacting nip part between the fixing member and the pressure member and sandwiching/carrying the material to be heated, the fixing member comprising the endless belt-shaped fixing member according to claim 6.

9. The heat-fixing device according to claim 8, wherein the heat-fixing device is used for fixing an unfixed toner image in an electrophotographic image forming apparatus.

* * * * *